US008013713B2

(12) United States Patent
Hetzler

(10) Patent No.: US 8,013,713 B2
(45) Date of Patent: Sep. 6, 2011

(54) RESISTOR, PARTICULARLY SMD RESISTOR, AND ASSOCIATED PRODUCTION METHOD

(75) Inventor: Ullrich Hetzler, Dillenburg/Oberscheld (DE)

(73) Assignee: Isabellenhutte Heusler GmbH & Co. KG, Dillenburg (DE)

( * ) Notice: Subject to any disclaimer, the term of this patent is extended or adjusted under 35 U.S.C. 154(b) by 445 days.

(21) Appl. No.: 12/375,276

(22) PCT Filed: Oct. 18, 2007

(86) PCT No.: PCT/EP2007/009057

§ 371 (c)(1),
(2), (4) Date: Jan. 27, 2009

(87) PCT Pub. No.: WO2008/055582

PCT Pub. Date: Mar. 15, 2008

(65) Prior Publication Data

US 2009/0322467 A1 Dec. 31, 2009

(30) Foreign Application Priority Data

Dec. 20, 2006 (DE) ..... 10 2006 060 387

(51) Int. Cl.
*H01C 1/012* (2006.01)

(52) U.S. Cl. ..... 338/309; 338/332; 29/610.1

(58) Field of Classification Search ..... 338/307–309, 338/332, 22 R; 29/610.1, 612
See application file for complete search history.

(56) References Cited

U.S. PATENT DOCUMENTS

| | | | | |
|---|---|---|---|---|
| 4,574,263 | A * | 3/1986 | Liddiard | 338/18 |
| 4,646,057 | A * | 2/1987 | Reynolds | 338/312 |
| 4,792,781 | A | 12/1988 | Takahashi et al. | |
| 5,179,366 | A * | 1/1993 | Wagner | 338/313 |
| 5,379,016 | A | 1/1995 | Smith et al. | |
| 5,994,996 | A * | 11/1999 | Van Den Broek et al. | 338/308 |
| 2004/0252009 | A1 | 12/2004 | Tsukada | |

FOREIGN PATENT DOCUMENTS

| | | | |
|---|---|---|---|
| DE | 3027122 | A1 | 2/1982 |
| DE | 3705279 | A1 | 8/1987 |
| DE | 4339551 | C1 | 10/1994 |
| DE | 19646441 | A1 | 5/1998 |
| DE | 69902599 | T2 | 1/2003 |
| EP | 0509582 | A2 | 10/1992 |
| EP | 0841668 | A1 | 5/1998 |
| EP | 0929083 | A1 | 7/1999 |

OTHER PUBLICATIONS

International Search Report for PCT/EP2007/009057.

* cited by examiner

*Primary Examiner* — Kyung Lee
(74) *Attorney, Agent, or Firm* — Caesar, Rivise, Bernstein, Cohen & Pokotilow, Ltd.

(57) ABSTRACT

The invention relates to a resistor (18), particularly an SMD resistor, including a planar, metallic support element (19) that has a top surface and a bottom surface, a planar resistor element (21) which is made of a resistive material and is disposed on the bottom surface of the support element (19), and at least two separate metallic connecting parts (23, 23) which electrically contact the resistor element (21) and are arranged in part on the bottom surface of the support element (19). The connecting parts (22, 23) are laterally exposed on the resistor (18) and can be laterally wetted in a visible manner by a solder. The invention further relates to a corresponding production method.

30 Claims, 5 Drawing Sheets

State of the art

State of the art

RESISTOR, PARTICULARLY SMD RESISTOR, AND ASSOCIATED PRODUCTION METHOD

BACKGROUND OF THE INVENTION

The invention relates to a resistor, in particular an SMD resistor, and a corresponding production method according to the invention.

FIG. 4 shows an exemplary embodiment of a conventional SMD (Surface Mounted Device) resistor 1, which is marketed by the applicant and which in a similar form is described, for example, in DE 43 39 551 CI. The known SMD resistor 1 comprises a planar metallic substrate 2, which may be composed of copper, for example. In the production process an electrically insulating adhesive layer 3 is applied to the upper side of the substrate 2, and then serves to bond a resistive film to the upper side of the substrate 2. The resistive film is then structured by an etching process, so that a meandering resistance path 4 is formed on the upper side of the substrate 2. The resistor 1 is then covered by a protective lacquer 5, which electrically insulates the resistance path 4. Before completion, a transverse incision 6 is then made in the substrate 2, which divides the substrate 2 into two separate support elements 2.1, 2.2, thereby preventing a direct flow of current between the two support elements 2.1, 2.2. The support elements 2.1, 2.2 therefore here form the electrical connection parts of the SMD resistor 1, which can be soldered onto solder pads 7, 8, as is indicated schematically by the arrows in the drawing.

A disadvantage to the known SMD resistor 1 is the intricate electrical connection of the underlying support elements 2.1, 2.2 to the resistive film bonded on top, which forms the resistance path 4. For this purpose a conductive surface must first be achieved in preparation for a current-carrying, electroplated contact on the outer edge of the adhesive layer 3 (chemical through-hole plating), before then in a multistage electroplating process applying a layer of copper, which will reliably conduct the total current. This contact, however, is part of the current path through the SMD resistor and therefore also has an influence on the resistance of the SMD resistor 1, which in the case of low impedances with a resistance of less than 25 mΩ means that the resistance has to be adjusted on the separated individual SMD resistor 1, a resistance adjustment on a blank with multiple resistors in this case being precluded.

A further disadvantage of the known SMD resistor 1 stems from the incision 6 in the substrate 2, since the incision 6, for mechanical stabilizing of the SMD resistor 1, is filled with a lacquer or epoxy resin, which expands during the soldering-on process and leads to bending of the SMD resistor 1, the bending being virtually frozen in once the solder has solidified, and at very least leaving a visible defect in the finished component. This problem occurs particularly with the use of lead-free solders, which require a higher soldering temperature. In addition, a certain volume of lacquer is needed in the incision 6, in order to mechanically stabilize the SMD resistor 1 despite the presence of the incision 6, which in turn implies that the substrate 2 is relatively thick. In practice, the substrate 2 must therefore have a thickness of at least 0.5 mm, which places limits on the miniaturization of the SMD resistor 1. Regardless of the thickness of the substrate 2, the mechanical load-bearing capacity of the SMD resistor 1 is limited by virtue of the mechanical weakening introduced by the incision 6.

A further disadvantage of the SMD resistor 1 results from the high electroplating costs, which account for approximately 25% of the total production costs. These high electroplating costs stem from the fact that the lateral contact of the two support elements 2.1, 2.2 to the resistance path 4 must carry the full current flow, so that the demands placed on the density and the effective cross-section of the electroplated copper layer are relatively high. In addition, at low-impedance resistance values the influence of the copper on the electrical characteristics is not entirely negligible.

Finally the support elements 2.1, 2.2 as connection parts do not conform to the usual standard dimensions of solder pads, but are substantially greater in length. Any shortening of the two support elements 2.1, 2.2 and hence a widening of the incision 6, however, would lead to a further mechanical and thermal weakening and is therefore not possible.

FIG. 5 shows another type of a known SMD resistor 9, which is marketed by the applicant, a similar type also being described in EP 0 929 083 B1. The SMD resistor 9 comprises a planar, thin aluminum substrate 10, the substrate 10 in this type having no incision and hence no mechanical weakening. Bonded to the underside of the planar substrate 10 by an adhesive layer 11 is a resistive film 12, which is structured by an etching process and forms a meandering resistance path. Lamellar copper contacts 13 are applied to the underside on the narrow end sides of the SMD resistor 9, and form electrical contacts with lamellar connection parts 14, 15. Finally, the SMD resistor 9 of this type has a protective lacquer coating 16, 17 on the upper side and on the underside.

Of advantage in this type of the SMD resistor 9 is firstly the fact that the substrate 10 has no mechanical weakening, so that the ensuing problems described above are avoided.

A disadvantage of the SMD resistor 9, however, is the fact that the connection parts 14, 15 and hence also the soldering points are situated on the underside of the SMD resistor 9, where the soldering points are not open to visual inspection. Attaching soldering points laterally is not possible in the case of the SMD resistor 9, however, since the soldering points would otherwise create an unwanted electrical shunt via the electrically conductive substrate 10.

A further disadvantage of the SMD resistor 9 is that the substrate 10 of anodized aluminum is relatively hard, which means that when separating the SMD resistor 9 by sawing, the life of the saw blade is reduced. In addition, sawing off the individual SMD resistors 9 from an aluminum blank leads to an unwanted saw burr on the sawn-off SMD resistor 9, owing to the low melting point of the aluminum compared to copper.

Finally, applying the protective lacquer 6 to the upper side of the SMD resistor 9 and the inscription of the SMD resistor 9 leads to material-based production problems.

Another conventional type of SMD resistor finally comprises a planar ceramic substrate, which on its upper side carries a structured resistive film, the resistive film likewise forming a meandering resistance path. The electrical contact of the SMD resistor is here achieved by solder caps of a highly conductive, generally electroplate-reinforced, solderable metallic layer (for example nickel-chromium alloy), the solder caps being of U-shaped cross-section and enclosing the opposing narrow edges of the SMD resistor with a cap shape. The solder caps are here laterally accessible, so that when soldering up laterally visible soldering points are produced, which facilitate visual inspection of the soldered connections.

A disadvantage with this type, however, is the fact that the substrate is composed of ceramic and therefore has a relatively low thermal conductivity compared to copper (cf. FIG. 4) or aluminum (cf. FIG. 5) and a low coefficient of thermal expansion poorly suited to a normal circuit board. In addition, the resistive film is here located on the upper side of the substrate, which has the detrimental influences on the overall resistance previously described.

Similar resistors having a non-metallic support element are disclosed in US 2004/0252009 A1 and DE 30 27 122 A1, for example.

Finally, DE 196 46 441 A1 discloses a resistor, in which the connection parts, however, are attached solely to the underside, so that no visual inspection of the soldered connection is possible.

Proceeding from the known SMD resistor 9 according to FIG. 5, the object of the invention, therefore, is to eliminate the disadvantages of the SMD resistor 9, by facilitating visual inspection of the soldering points.

This object is achieved by a resistor and a production method according to the invention.

SUMMARY OF THE INVENTION

The invention embraces the general technical teaching of arranging the connection parts on the resistor laterally exposed, so that the connection parts can be wetted by a solder in manner that is visible, in order to allow a visual inspection of the respective soldered connection.

The resistor according to the invention is preferably embodied as an SMD resistor and allows a conventional surface mounting. The invention is not confined to SMD resistors, however, but in principle also encompasses other types of resistors which, for example, provide for a conventional contact by solder pins.

The resistor according to the invention furthermore comprises a plane metallic support element, which due to the composition of its metallic material has a good thermal conductivity and a suitable coefficient of thermal expansion, which is advantageous in the operation of the resistor according to the invention.

In addition the resistor according to the invention has a plane resistance element composed of a resistive material, the resistance element being located on the underside of the plane support element.

The term "a plane resistance element or support element" used in the context of the invention is to be interpreted in general terms and is not confined to the mathematical or geometric definition of a planar surface. This feature is preferably intended to imply, however, that the lateral extent of the support element or the resistance element is substantially greater than the thickness of the support element or resistance element. In addition, this feature also preferably embraces the idea that the upper side and the underside of the support element or resistance element in each case run parallel to one another. The support element and the resistance element are furthermore preferably planar, although, curved or arched shapes of the support element and the resistance element are also possible.

In addition, the resistor according to the invention comprises at least two separate metallic connection parts, which form the electrical contacts of the resistance element and are partially located on the underside of the support element. In contrast to the known SMD resistor according to FIG. 5 described in the introductory part, however, the connection parts are not located entirely on the underside, but are at least in part exposed at the side of the resistor, so that when soldering up laterally visible soldering points are formed, which facilitate visual inspection.

The metallic connection parts preferably each extend laterally on the resistor upwards to the metallic support element, where the connection parts touch and come into electrical and thermal contact with the support element. For example, the connection parts may each have a U-shaped cross-section and each enclose the resistor on opposite edges in a cap shape, a lateral metal coating in the contact area also being possible.

In the resistor according to the invention, however, the metallic support element only serves as a substrate and as a thermal conductor, the support element in the resistor according to the invention not being intended to serve as an electrical conductor, in order to avoid unwanted shunts via the metallic support element. The metallic support element in the resistor according to the invention therefore preferably has an incision, which divides the support element into at least two parts electrically isolated from one another, and prevents a flow of current between the two connection parts via the support element. In its simplest form the incision may be embodied in the same way as in the known SMD resistor according to FIG. 4, in which the resistive film, however, is located on the upper side of the substrate. The incision in the support element, however, preferably runs at least partially slanting, for example in a V-shape, a W-shape or in a meandering shape. Such a design shape of the incision in the support element advantageously leads to a greater mechanical stability of the resistor than is the case with a transverse incision.

The connection parts in the resistor according to the invention are furthermore preferably of a size adapted to suit standard solder pads, so that the resistor according to the invention differs from the known SMD resistor according to FIG. 4, in which the connection parts have a substantially greater lateral extent. In the resistor according to the invention the connection parts therefore preferably have a lateral extent, which is less than 30%, 20% or 15% of the distance between the two connection parts. In the case of an extreme miniaturization of the resistor according to the invention, a dimensioning of the connection parts relative to the distance between the connection parts on the other hand leads to excessively small connection parts. Limits of 1 mm, 0.5 mm or 0.1 mm can then be defined as maximum values for the lateral extent of the connection parts. For example, the lamellar connection parts may have a width ranging from 0.1-0.3 mm (type 0402), 0.15-0.40 mm (type 0603), 0.25-0.75 mm (type 1206) or 0.35-0.85 mm (type 2512).

The resistive material of the resistor according to the invention is preferably composed of a copper-manganese alloy, such as a copper-manganese-nickel alloy, for example. For example, the alloys CuMnl2Ni, CuMn7Sn or CuMn3 may be used as resistive material. Alternatively it is also possible, within the scope of the invention, to use a nickel-chromium alloy, in particular a nickel-chromium-aluminum alloy as resistive material. Examples of such possible alloys are NiCr20AlSiIMnFe, NiCr6015, NiCr8020 and NiCr3020. In addition, the resistance element may also be composed of a copper-nickel alloy, such as CuNi15 or CuNi10, for example. In the resistive material that can be used, however, the invention is not limited to the examples cited above, other resistive materials also in principle being feasible.

It should further be mentioned that the resistor according to the invention preferably has a high degree of miniaturization. For example, the thickness of the resistor according to the invention may be less than 2 mm, 1 mm, 0.5 mm or even 0.3 mm. The length of the resistor according to the invention may be less than 10 mm, 5 mm, 2 mm or even less than 1 mm. The width of the resistor according to the invention on the other hand is preferably less than 5 mm, 2 mm or even less than 1 mm.

Accordingly, the support element in the resistor according to the invention preferably has a thickness ranging from 0.05-0.3 mm.

It should further be mentioned that the resistor on its outside is preferably coated with a temperature-resistant insulation layer (hereinafter generally referred to as solder resist), which is familiar from conventional SMD resistors. The solder resist in the resistor according to the invention is therefore preferably applied to the upper side of the support element and to the underside of the resistance element.

In addition it should be mentioned that the connection parts are preferably composed of a highly conductive material, in order to achieve the smallest possible connection resistance. The support element and/or the connection parts in the resistor according to the invention are furthermore preferably composed of a thermally highly conductive material, in order to achieve an efficient heat dissipation from the resistance element, for example. The connection parts and/or the support element may for this purpose be composed of copper or a copper alloy, for example.

The individual connection parts are preferably cap-shaped and may be of U-shaped cross-section, for example. In such a cap-shaped connection part having a U-shaped cross-section, the upper leg of the connection part encloses the support element at the top, whilst the lower leg of the U-shaped connection part encloses the resistance element at the bottom. In such a cap-shaped connection part the cap-shaped connection part is preferably intended to enclose the support element and/or the resistance element not only at top and bottom but also laterally. This is possible if the cap-shaped connection parts are applied only when the resistors are parted from the blank in the course of the production process according to the invention, since only then are the lateral cut faces of the detached resistors exposed.

It should further be mentioned, that even in the resistor according to the invention an adhesive layer is preferably located between the plane resistance element and the plane support element. For one thing, the adhesive layer fixes the plane resistance element to the underside of the support element. For another, the adhesive layer is electrically insulating and therefore prevents unwanted electrical shunts via the metallic support element.

The plane resistance element in the resistor according to the invention is furthermore preferably structured by an etching process or in some other way (for example by laser machining), so that the resistance element has a simple rectangular or meandering resistance path, as is also the case with the known SMD resistors described in the introductory part.

The resistor according to the invention allows advantageously low resistances in the milliohm range, in which the resistance may be less than 500 mΩ, 200 mΩ, 50 mΩ, 30 mΩ, 20 mΩ, 10 mΩ, 5 mΩ or even less than 1 mΩ.

It should further be mentioned that the resistance element in the resistor according to the invention preferably affords complete external electrical insulation, apart from the connection parts.

However, the invention encompasses not only the resistor according to the invention described above but also a corresponding production method, in which the connection parts are attached to the resistor so that the connection parts are laterally exposed and can be wetted by a solder in a manner that is visible, in order to allow a visual inspection of the respective soldering point.

In the production method according to the invention the incision in the metallic support element described above can be made, for example, by an etching process or by laser machining.

The same applies to the structuring of the resistance element to form the meandering resistance path, which can likewise be made by an etching process or by laser machining.

It should further be mentioned with regard to the production method according to the invention that the resistors can be separated from a blank by sawing, by punching or by laser cutting. In producing the support elements from copper, the invention advantageously allows a longer service life of the saw blade used, since copper is substantially softer than the anodized aluminum used in the known SMD resistor according to FIG. 5, described in the introductory part.

In addition the invention advantageously allows a resistance adjustment to be carried out on a blank with multiple resistors not yet separated, so that after separation of the resistors no further resistance adjustment is necessary.

Other advantageous developments of the invention are explained in more detail below together with the description of the preferred exemplary embodiments of the invention, with reference to the drawings, in which:

DETAILED DESCRIPTION OF PREFERRED EMBODIMENTS

Figure 1:
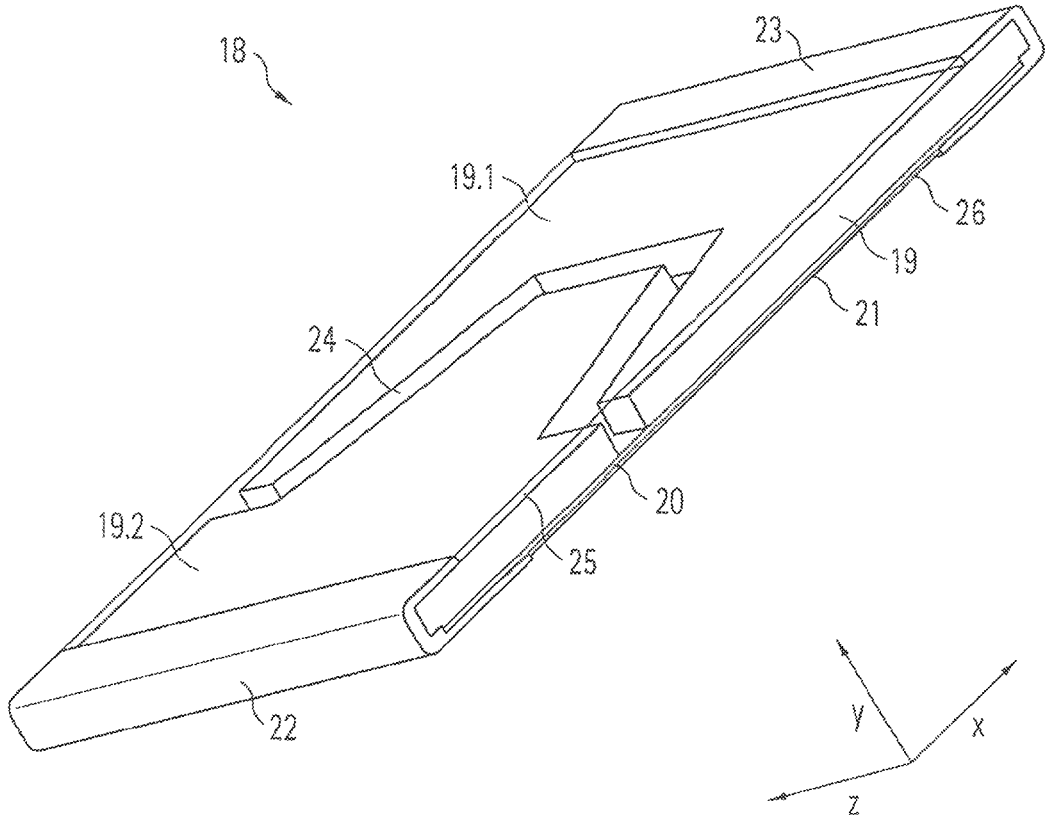
FIG. 1 shows a perspective view of an SMD resistor according to the invention.

The cross-sectional view in FIG. 1 shows an SMD resistor 18 according to the invention, which may be of type 0604, for example. This means that the SMD resistor 18 has a length in the X direction of 0.06 inches (1.524 mm) and a width in the Z direction of von 0.04 inches (1.016 mm). The SMD resistor 18 may furthermore have a thickness in the Y direction of 0.4 mm, for example.

The SMD resistor 18 has a planar support element 19 made of copper, a resistive film 21 of a copper-manganese-nickel alloy (CuMn12Ni) being adhesively bonded to the underside of the support element 19 by means of an adhesive layer 20. For one thing, the adhesive layer 20 produces a fixing of the resistive film 21 on the underside of the planar support element 19. For another, the adhesive layer 20 is electrically insulating and therefore insulates the conductive support element 19 from the resistive film 21.

The SMD resistor 18 furthermore has cap-shaped connection parts 22, 23 on either side, the two connection parts 22, 23 enclosing the support element 19 and the resistive film 21 at the top, sides and bottom. The two connection parts 22, 23 therefore electrically bond the resistive film 21, so that in the assembled state a current can flow via the two connection parts 22, 23 and the resistive film 21.

In the planar support element 19 is a substantially V-shaped incision 24, which divides the support element 19 into two parts 19.1, 19.2, the two parts 19.1, 19.2 being electrically isolated from one another by the incision 24. In conjunction with the incision 24, the adhesive layer 20 between the resistive film 21 and the planar support element 19 therefore prevents unwanted electrical shunts via the support element 19. The support element 19 therefore here serves solely as mechanical substrate and to dissipate heat, but not to conduct current.

Finally, it should also be mentioned that a solder resist 25 is applied to the upper side of the support element 19 and extending between the two connection parts 22, 23. In addition, a solder resist 26 is also applied to the underside of the resistive film 21 and extending between the two connection parts 22, 23. In the SMD resistor 18 the resistive film 21 is therefore completely insulated externally except for the connection parts 22, 23.

The production method according to the invention will now be described below with reference to FIGS. 2A-2G and to the flow chart in FIG. 3, FIGS. 2A-2G showing various intermediate stages of the SMD resistor 18 according to the invention.

Figure 2A:
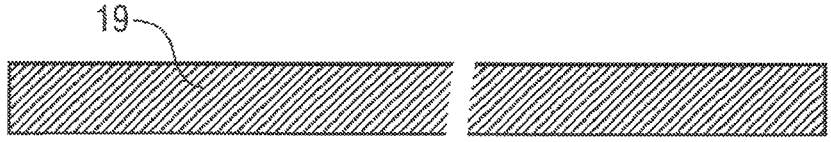
FIGS. 2A-2G show various stages in the production of an SMD resistor according to the invention.

In a first step S1 of the production method according to the invention the support element 19 in the form of a copper-foil is first prepared, as is shown in FIG. 2A.

Figure 2B:
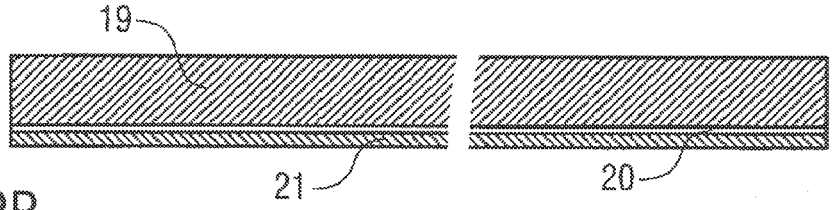
Figure 2C:
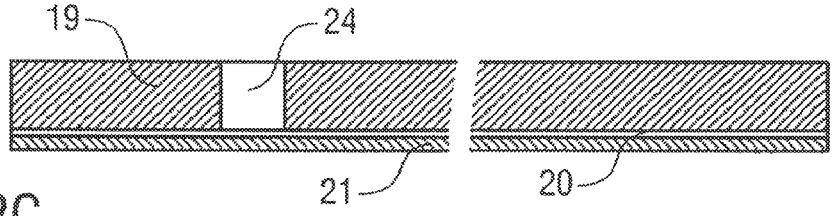

In a further step S2 the resistive film 21 is then adhesively bonded onto the underside of the support element 19, the bonding being achieved by means of the adhesive layer 20, as can be seen from FIG. 2B.

In the next step S3 the incision 24 is then made in the support element 19, in order to prevent any subsequent electrical shunt via the electrically conductive support element 19. The incision 24 can be produced by an etching process or by laser machining, for example. The step S3 leads to the intermediate stage according to FIG. 2C.

In step S4 a solder resist is then applied to the upper side of the support element 19, in a manner known in the art.

In a further step S5 an etched structure is then introduced into the resistive film 21, which then subsequently forms a meandering resistance path.

Figure 2D:
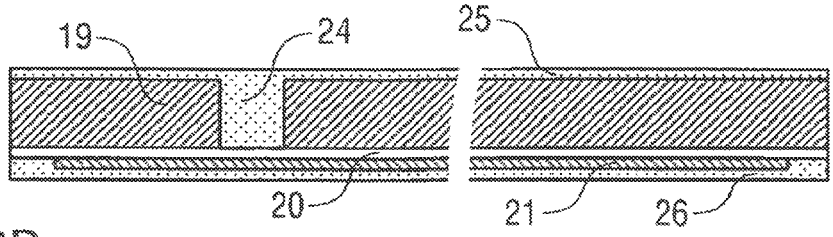

In step S6 the solder resist 26 is then applied to the underside of the resistive film 21, as can be seen from FIG. 2D.

Figure 2E:
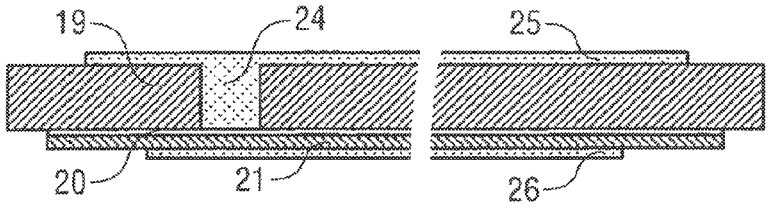
Figure 2F:
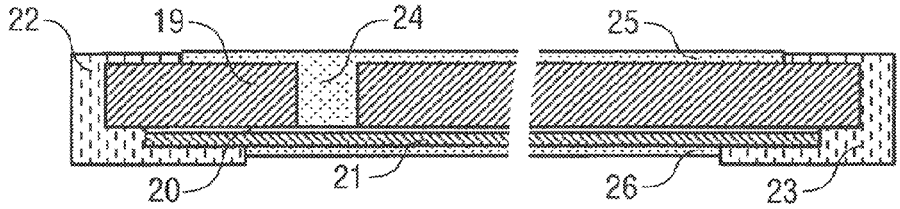

In the next steps S7 and S8 there then follows a lamellar exposure of the support element 19 at the opposite edges of the SMD resistor 18 in the X-direction, in order that the connection parts 22, 23 can then come into thermal contact with the support element 19. The cross-sectional view in FIG. 2E shows this state after the lamellar exposure of the support element.

In step S9 a copper layer with a thickness of 10 μm, for example, is then applied to the exposed edges of the resistive film 21 on the underside thereof.

In the next step S10 a resistance adjustment is then performed on a blank with numerous SMD resistors not yet separated.

Following the individual resistance adjustment, the SMD resistors are then parted from the blank in step S11, which may be done by sawing, punching or by laser machining.

In a final step S12 the connection parts 22, 23 are then applied as solder caps to the exposed edges. Applying the connection parts 22, 23 in this way after separating the SMD resistor 18 allows the connection parts 22, 23 to also enclose the support element 19 laterally at the cut faces, as can be seen from the perspective view in FIG. 1.

Figure 2G:
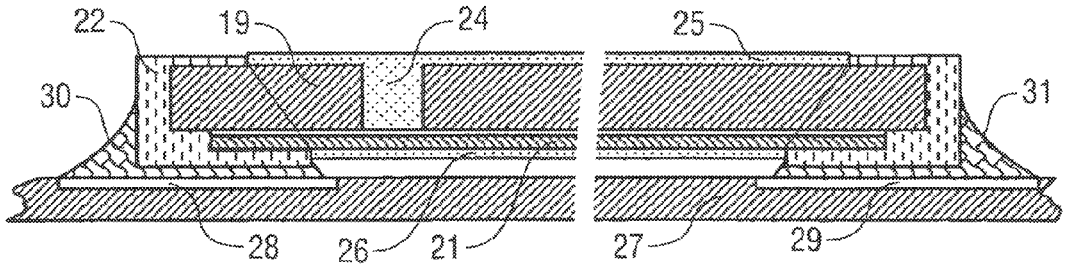
Figure 3:
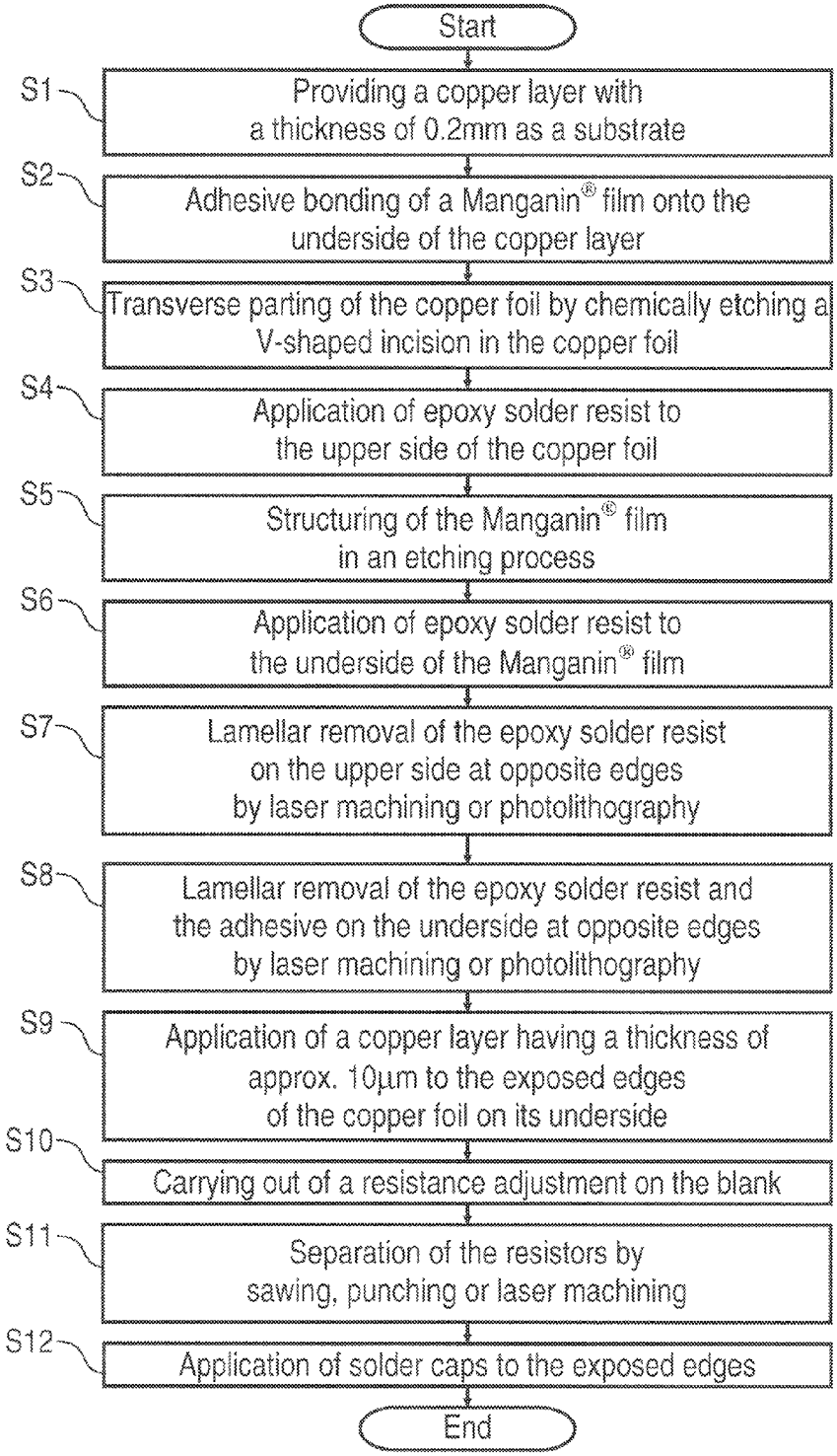
FIG. 3 shows the production method according to the invention in form of a flow chart.
Figure 4:
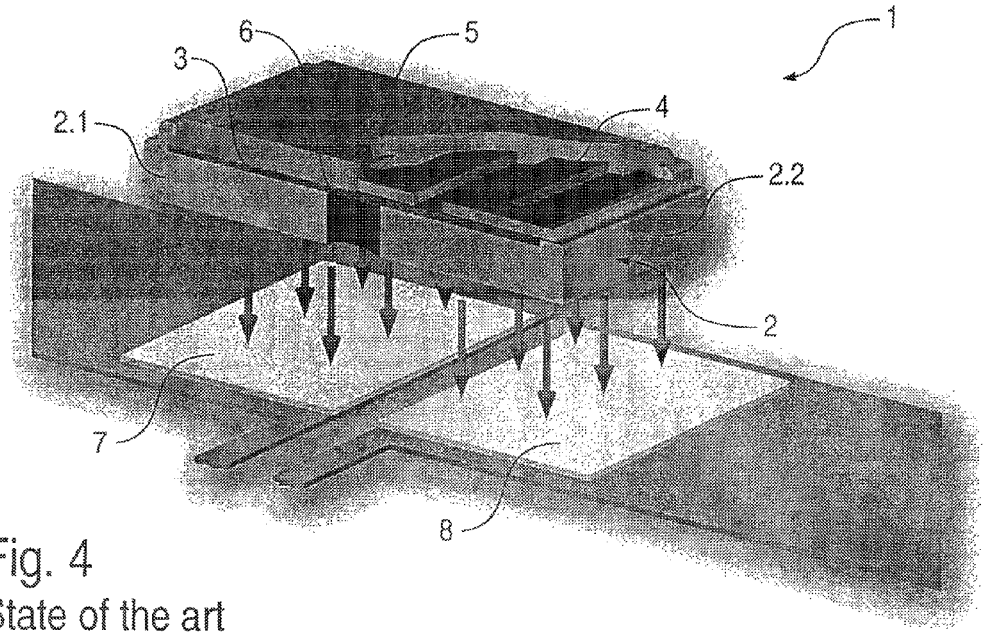
FIG. 4 shows a perspective of the known SMD resistor described in the introductory part.
Figure 5:
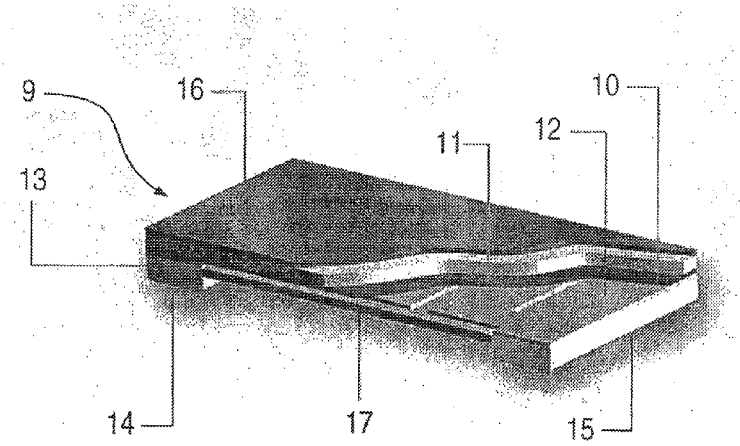
FIG. 5 shows a perspective view of the SMD resistor likewise described in the introductory part.

FIG. 2G finally shows the SMD resistor 18 according to the invention on a circuit board 27 with two standard solder pads 28, 29 and two soldering points 30, 31. It can be seen from the cross-sectional view that the soldering points 30, 31 are exposed at the sides of the SMD resistor 18 and are therefore open to visual inspection.

The invention is not limited to the preferred exemplary embodiments described above, a number of variants and modifications instead being possible, which also make use of the idea of the invention and therefore come within the scope of the patent.

List of Reference Numerals

1 SMD resistor
2 substrate
2.1, 2.2 support elements
3 adhesive layer
4 resistance path
5 protective lacquer
6 incision
7 solder pad
8 solder pad
9 SMD resistor
10 substrate
11 adhesive layer
12 resistive film
13 copper contacts
14, 15 connection parts
16, 17 protective lacquer coat
18 SMD resistor
19 support element
19.1, 19.2 parts
20 adhesive layer
21 resistive film
22, 23 connection parts
24 incision
25, 26 solder resist
27 circuit board
28, 29 standard solder pads
30, 31 soldering points

The invention claimed is:

1. A resistor comprising:

a) a flat, electrically and thermally conductive metal support element with an upper side and an underside, b) a flat resistor element made of a resistance material, wherein the resistor element is arranged on the underside of the metal support element, c) at least two separate metal connection parts, which electrically connect the resistor element and are partially arranged on the underside of the metal support element, wherein d) the metal connection parts are exposed laterally on the resistor and are visible from the side to be wettable by a solder, e) the metal connection parts respectively extend upwards laterally on the resistor to the metal support element and touch and electrically and thermally connect the metal support element, and f) the metal support element has an incision, which divides the metal support element into at least two parts insulated electrically from one another and prevents a current flow via the metal support element between the two connection parts.

2. The resistor according to claim 1, wherein the incision in the metal support element runs at least partially on an angle.

3. The resistor according to claim 2, wherein the incision runs in a V shape, a W shape or a meander shape in the metal support element.

4. The resistor according to claim 1, wherein:

a) the metal connection parts have a lateral extent, which is smaller than 30% of the lateral extent of the resistor to facilitate the connection of standard solder pads, and b) the metal connection parts have a lateral extent, which is smaller than 1 mm to facilitate the connection of standard solder pads.

5. The resistor according to claim 1, wherein the high-resistivity material is a member selected from the group consisting of:

a) a copper-manganese alloy, b) a nickel-chromium alloy, and c) a copper-nickel alloy.

6. The resistor according to claim 1, comprising:

a) a thickness of less than 2 mm, b) a length of less than 10 mm, and c) a width of less than 5 mm.

7. The resistor according to claim 1, wherein the metal support element has a thickness that is less than 0.3 mm and more than 0.05 mm.

8. The resistor according to claim 1, wherein:

a) a surface of the upper side of the metal support element is coated with a solder resist, and b) a surface of the underside of the resistor element is coated with a solder resist.

9. A resistor element of the resistor according to claim 1, wherein:

a) the metal connection parts are made of a material containing copper, and b) the metal support element is made of a material containing copper.

10. The resistor according to claim 1, wherein:

a) the individual connection parts engage over the metal support element at the top and the resistor element at the bottom in a cap-like manner, and b) the individual connection parts engage over the metal support element and the resistor element laterally in a cap-like manner.

11. The resistor according to claim 1, further comprising an adhesive layer between the resistor element and the metal support element.

12. The resistor according to claim 1, wherein the resistor element has a resistance path in a simple rectangular shape.

13. The resistor according to claim 1, comprising a resistance value of less than 500 mΩ.

14. The resistor according to claim 1, wherein the resistor element is fully electrically insulated to the outside except for the connection parts.

15. A process for the production of resistors, comprising the following steps:

a) providing a flat, electrically and thermally conductive metal support element with an upper side and an underside, b) applying a flat resistor element made of a resistance material onto the underside of the metal support element, c) electrically connecting the resistor elements by at least two separate metal connection parts, which are arranged partially on the underside of the metal support element, wherein:

d) the metal connection parts are attached to the resistor so that the metal connection parts are exposed laterally on the resistor and are visible from the side to be wettable by a solder, e) the metal connection parts are attached to the resistor so that the metal connection parts respectively extend laterally on the resistor upwards to the metal support element and touch and electrically and thermally connect the metal support element, and f) an incision is generated in the metal support element, wherein the incision divides the metal support element into two parts and prevents a current flow via the metal support element between the two connection parts.

16. The production process according to claim 15, wherein the incision is created in the metal support element by etching.

17. The production process according to claim 15, wherein the incision is formed in the metal support element at least partially on an angle.

18. The production process according to claim 15, wherein the resistor element is adhered to the underside of the metal support element by an adhesive layer.

19. The production process according to claim 15, wherein the resistor element is structured by etching.

20. The production process according to claim 15, wherein a meander-shaped resistance path is generated in the resistor element as a result of a structuring of the resistor element.

21. The production process according to claim 15, further comprising the following steps:

a) applying a solder resistor over a surface of the upper side of the metal support element, and b) applying a solder resist over a surface of the underside of the resistor element.

22. The production process according to claim 21, further comprising the following steps:

a) removal in a strip of the solder resist on the upper side of the metal support element on two opposite edges, b) removal in a strip of the solder resist on the underside of the resistor element on the opposite edges, c) removal in a strip of the adhesive layer between the metal support element and the resistor element on the opposite edges, and d) removal in a strip of the resistor element on the underside of the metal support element on the two opposite edges to expose the resistor element in a strip shape for an electrical connection.

23. The production process according to claim 15, further comprising the following step:

isolating the resistors by separation from a panel comprising a plurality of resistors.

24. The production process according to claim 23, wherein the resistors are isolated by sawing, stamping or by laser-cutting the panel.

25. The production process according to claim 23, further comprising the following step:

conducting a resistance balancing before isolating the resistors.

26. The production process according to claim 15, wherein the connection parts are attached after resistance balancing and after isolation.

27. The resistor according to claim 1, wherein the resistor element has a resistance path extending in a meander shape.

28. The production process according to claim 15, wherein the incision is created in the metal support element by laser machining.

29. The production process according to claim 15, wherein the incision is formed in the metal support element at least partially in a shape selected from a group consisting of:

a) a V shape, b) a W shape, and c) a meander shape.

30. The production process according to claim 15, wherein the resistor element is structured by laser machining.

* * * * *